US010126022B1

(12) United States Patent
Cooper

(10) Patent No.: US 10,126,022 B1
(45) Date of Patent: Nov. 13, 2018

(54) REFRIGERATION WARMING SYSTEM FOR REFRIGERATION SYSTEMS

(71) Applicant: Thomas Cooper, Kent City, MI (US)

(72) Inventor: Thomas Cooper, Kent City, MI (US)

(73) Assignee: COOPER RESEARCH, LLC, Kent City, MI (US)

( * ) Notice: Subject to any disclaimer, the term of this patent is extended or adjusted under 35 U.S.C. 154(b) by 12 days.

(21) Appl. No.: 15/587,750

(22) Filed: May 5, 2017

(51) Int. Cl.

| | |
|---|---|
| ***F25B 1/00*** | (2006.01) |
| ***F25B 5/04*** | (2006.01) |
| ***F25B 39/00*** | (2006.01) |
| ***F25B 41/00*** | (2006.01) |
| *F25B 39/02* | (2006.01) |

(52) U.S. Cl.
CPC ..... *F25B 5/04* (2013.01); *F25B 39/00* (2013.01); *F25B 41/003* (2013.01); *F25B 39/028* (2013.01)

(58) Field of Classification Search
CPC ..... F25B 5/04; F25B 39/00; F25B 41/003; F25B 39/028; F25B 41/062; F25B 49/022; F25B 1/00; F25B 13/00
See application file for complete search history.

(56) References Cited

U.S. PATENT DOCUMENTS

| | | | | | |
|---|---|---|---|---|---|
| 2,512,545 | A * | 6/1950 | Hazard | F25B 25/005 | 62/434 |
| 3,003,332 | A * | 10/1961 | Watkins | F25B 1/00 | 62/184 |
| 4,245,476 | A * | 1/1981 | Shaw | F24D 11/0221 | 62/235.1 |
| 4,322,952 | A * | 4/1982 | Nakagawa | F25B 41/00 | 417/208 |
| 4,332,138 | A * | 6/1982 | Nakagawa | F25B 5/04 | 62/199 |
| 4,514,990 | A * | 5/1985 | Sulkowski | F24D 3/08 | 62/238.7 |

* cited by examiner

*Primary Examiner* — Melvin Jones
(74) *Attorney, Agent, or Firm* — Flynn Thiel, P.C.

(57) ABSTRACT

A refrigeration system including a condenser, a compressor, a first transportation system passing refrigerant between the compressor and the condenser, a first evaporator, a second evaporator, a second transportation system passing the refrigerant between the condenser and a holding vessel, with the holding vessel including refrigerant in gas and liquid form, a third transportation system passing the refrigerant between the holding vessel and a pump, a fourth transportation system passing the refrigerant between the pump and the first evaporator, a fifth transportation system passing the refrigerant between the pump and the second evaporator, and a heat exchanger wherein the refrigerant in the second transportation system exchanges heat with the refrigerant in the fifth transportation system to heat the refrigerant in the fifth transportation system before the refrigerant passes to the second evaporator. The refrigerant is expanded between the condenser and the first and second evaporators to lower the pressure thereof.

12 Claims, 2 Drawing Sheets

REFRIGERATION WARMING SYSTEM FOR REFRIGERATION SYSTEMS

FIELD OF THE INVENTION

The present invention relates to a refrigeration system, and in particular to a refrigeration system that lessens a need for defrosting.

BACKGROUND OF THE INVENTION

Refrigeration systems are used to cool spaces in complexes (e.g., refrigeration systems) and also for cooling air entering a building (e.g., make-up air units).

SUMMARY OF THE INVENTION

A first aspect of the present invention is to provide a refrigeration system including a condenser, a compressor, a first transportation system passing refrigerant between the compressor and the condenser, a first evaporator, a second evaporator, a second transportation system passing the refrigerant between the condenser and a holding vessel, with the holding vessel including refrigerant in gas and liquid form, a third transportation system passing the refrigerant between the holding vessel and a pump, a fourth transportation system passing the refrigerant between the pump and the first evaporator, a fifth transportation system passing the refrigerant between the pump and the second evaporator, and a heat exchanger wherein the refrigerant in the second transportation system exchanges heat with the refrigerant in the fifth transportation system to heat the refrigerant in the fifth transportation system before the refrigerant passes to the second evaporator. The refrigerant is expanded between the condenser and the first and second evaporators to lower the pressure thereof.

Another aspect of the present invention is to provide a method of refrigeration including providing a condenser, a compressor, a first evaporator, and a second evaporator. The method also includes transporting the refrigerant between the compressor and the condenser, transporting the refrigerant between the condenser and a holding vessel, with the holding vessel including refrigerant in gas and liquid form, transporting refrigerant between the holding vessel and a pump, transporting the refrigerant between the pump and the first evaporator, transporting the refrigerant between the pump and the second evaporator, transporting the refrigerant between the pump and the first evaporator and between the pump and the second evaporator through a heat exchanger, heating the refrigerant passing between the pump and the second evaporator with the refrigerant passing between the pump and the first evaporator in the heat exchanger, and expanding the refrigerant between the condenser and the first and second evaporators to lower the pressure of the refrigerant.

BRIEF DESCRIPTION OF THE DRAWINGS

One or more embodiments of the present invention are illustrated by way of example and should not be construed as being limited to the specific embodiments depicted in the accompanying drawings, in which like references indicate similar elements and in which.

The specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

DETAILED DESCRIPTION

Figure 1:
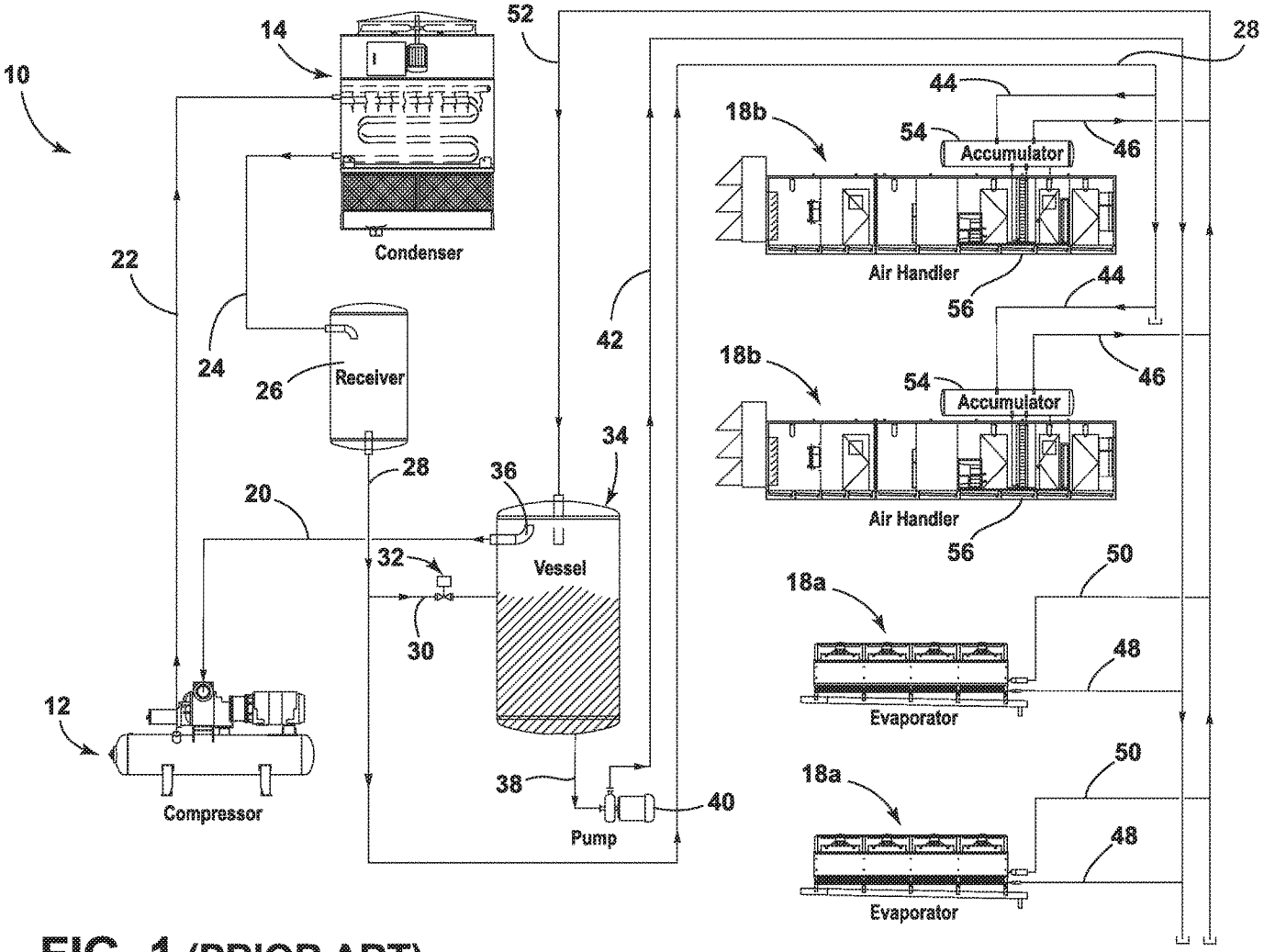
FIG. 1 (PRIOR ART)
FIG. 1 is a schematic drawing of a prior art refrigeration system.

The reference number 10 (FIG. 1) generally designates a prior art refrigeration system. The prior art refrigeration system 10 generally performs a refrigeration cycle having a refrigerant pass through a compressor 12 to raise the pressure of the refrigerant, pass to a condenser 14 (e.g., evaporative) to release heat from the refrigerant, pass through an expansion valve to lower the pressure of the refrigerant, pass through an evaporator 18*a* or air handler 18*b* to extract heat from the evaporator 18*a* or the air handler 18*b* into the refrigerant and finally pass back to the compressor 12. In the illustrated prior art refrigeration system 10, the evaporator 18*a* is a make-up air unit for lowering the temperature of air entering a building (i.e., the air "making up" for the air leaving the building through other vents, doors, etc.). The illustrated air handler 18*b* is sometimes referred to as a commercial refrigerator. Items placed within the air handler 18*b* are maintained at a temperature lower than atmospheric temperature. The refrigerant used in the system can be any fluid capable of efficiently passing through the refrigeration cycle (e.g., ammonia). The illustrated evaporator 18*a* and the air handler 18*b* are examples of evaporators that can be used in a prior art refrigeration system 10. As used herein, evaporator 18*a* or air handler 18*b* could be any evaporation system (e.g., the evaporator 18*a* discussed herein, the air handler 18*b* as discussed herein or any other evaporator such as a milk silo).

In the illustrated example, the compressor 12 receives the refrigerant in gas form through input line 20. After the refrigerant is compressed in the compressor 12, the refrigerant passes to the condenser 14 through line 22. In the condenser 14, the refrigerant maintains a substantially constant pressure, but has the temperature thereof lowered. The refrigerant then exits the condenser 14 through a condenser drain line 24 to pass the refrigerant into a receiver 26, which is used to maintain an excess of refrigerant that is not currently being used in the refrigeration cycle. The refrigerant exits the receiver 26 as a high pressure liquid into a branch line 28. The branch line 28 has a spur line 30 connected thereto. The spur line 30 passes to a vessel 34 discussed below and includes a valve 32 for allowing the refrigerant in the branch line 28 to pass therethrough and into the vessel 34 if the gas is above a certain pressure. The refrigerant that does not pass through the valve 32 in the spur line 30 proceeds through the branch line 28 to an air handler spur line 44 for each air handler 18*b*. The refrigerant passing to the air handler spur line 44 is a high pressure liquid. As discussed in more detail below, the refrigerant passing to the air handler 18*b* are held in an accumulator 54 before passing to a cooling area 56 of the air handler 18*b* to cool items in the cooling area 56 of the air handler 18*b*. After the refrigerant is employed to cool items in the cooling area 56 of the air handler 18*b*, the refrigerant is passed back through the accumulator 54 to an air handler return line 46. All the refrigerant from the air handler return lines 46 join a return suction line 52, which returns the refrigerant to the vessel 34.

In the illustrated example, the vessel 34 includes a gas outlet 36 providing refrigerant in gas form to the input line 20 and a liquid outlet 38 that provides the refrigerant in gas form to a pump 40. The pump 40 pumps the liquid refrigerant to evaporator spur lines 50 through a pump line 42. The liquid refrigerant passing through the pump line 42 is a medium temperature liquid. After the refrigerant passing to the evaporators 18*a* through the evaporator spur lines 50 is used to cool the air in the evaporators 18*a*, the refrigerant exits the evaporators 18*a* through evaporator return lines 48 that intersect with the return suction line 52 to return the refrigerant to the vessel 34.

In the prior art, the accumulators 54 receive liquid refrigerant and help to improve the efficiency of the air handlers 18*b* (and other evaporators) connected thereto. The air handlers 18*b* (and other evaporators) require the liquid refrigerant to be warmer than the temperatures of the fluid or air being handled in the air handlers 18*b* (and other evaporators). If the liquid refrigerant is below freezing, the liquid refrigerant can cause ice buildup or can affect the product being cooled. If there is ice buildup, the air handlers 18*b* (and other evaporators) utilizing below freezing refrigerant require defrosting, which is undesirable for continuous operation (e.g., undesirable for units typically found in industrial food and critical process areas). In the prior art, it is common to use hot refrigerant in gas form after passing through the evaporator to mix with the gas refrigerant from the condenser to warm the refrigerant, but in large applications there are energy penalties associated with these applications. Therefore, most common installations utilize a flooded arrangement such as the accumulator 54. Flooded arrangements such as the accumulator 54 require a vessel to be mounted on the air handler 18*b* (or other evaporators) that feeds the air handler 18*b* (or other evaporators) with high pressure warm or slightly sub-cooled liquid refrigerant. Flooded systems such as the accumulator 54 are very expensive, cumbersome and require vessels, control floats, safety systems, multiple sensors and insulation.

Figure 2:
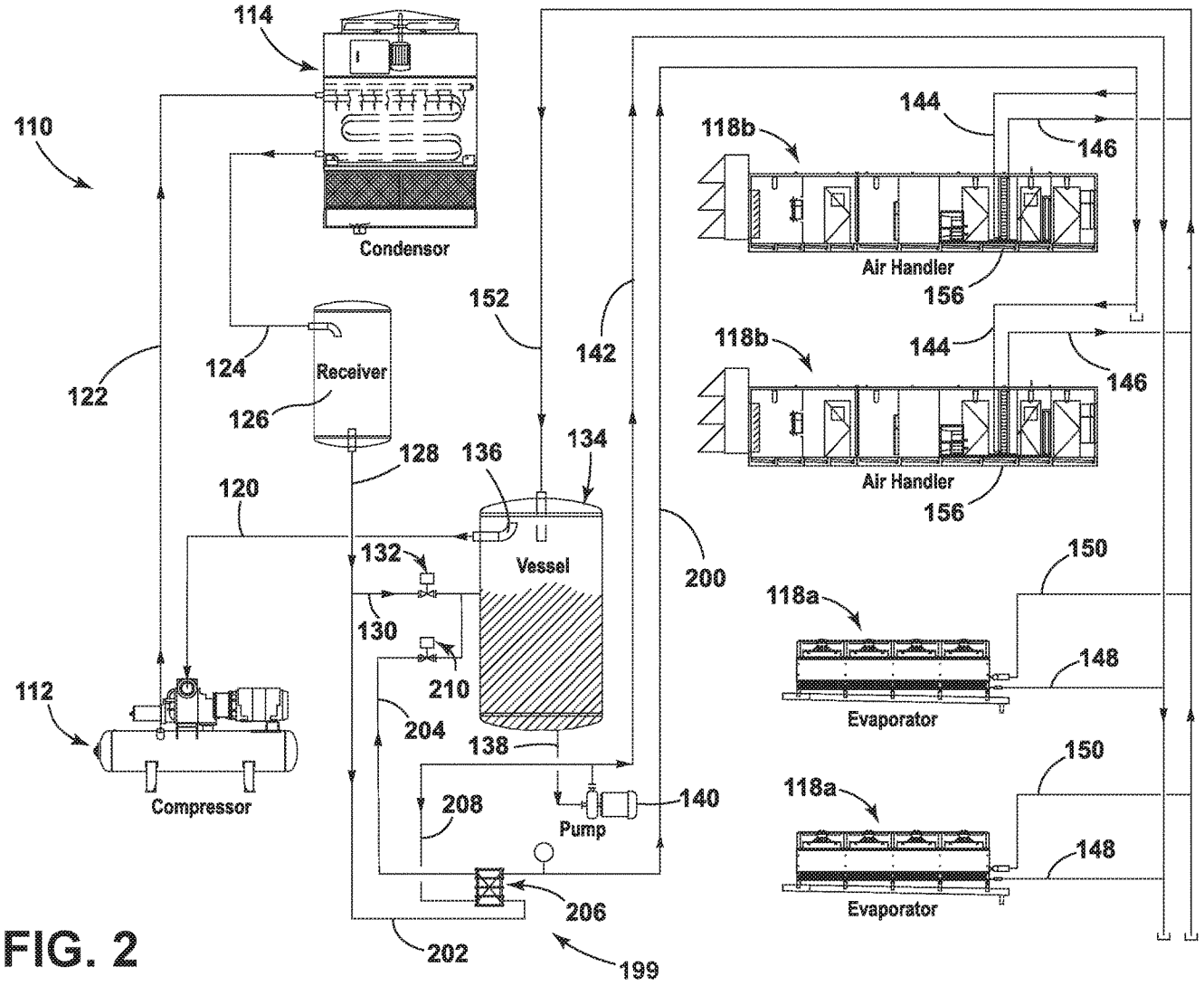
FIG. 2 is a schematic drawing of a refrigeration system according to the present invention.

FIG. 2 illustrates a refrigeration system 110 of the present invention that dispenses with use of a flooded system such as the accumulator 54 of the prior art. Since refrigeration system 110 is similar to the previously described refrigeration system, similar parts appearing in FIG. 1 and FIG. 2, respectively, are represented by the same, corresponding reference number, except that the numerals of the latter are in the hundreds (e.g., prior art compressor 12 is identical to compressor 112 of the present invention).

In the illustrated example, the refrigeration system 110 of the present invention includes a heat exchange subassembly 199 for heating the refrigerant before the refrigerant passes to the air handlers 118*b*. As shown in FIG. 2, the refrigerant leaves the vessel 134 passes to the pump 140. The refrigerant leaving the pump 140 at a low temperature (e.g., 17°) and splits into the pump line 142 and a heat rising line 208. The refrigerant in the heat rising line 208 passes through a heat exchanger 206 to raise the temperature of the refrigerant (e.g., to about 36°). After heating in the heat exchanger 206, the refrigerant passes through a warm temperature line 200 and directly to the air handler spur line 144 for each air handler 118*b*. The air handler spur line 144 does not lead to an accumulator as used in the prior art, but passes directly to the cooling area 156 of the air handler 118*b* to cool items in the cooling area 156 of the air handler 118*b*.

In the illustrated example, refrigerant from the receiver 126 is used to heat the refrigerant in the heat exchanger 206 of the heat exchange subassembly 199. As shown in FIG. 2, the branch line 128 leads to a heat lowering line 202 directly after the spur line 130. The heat lowering line 202 leads the refrigerant to the heat exchanger 206 to heat the refrigerant in the heat rising line 208. After leaving the heat exchanger 206, the refrigerant from the heat exchanger 206 passes to a return line 204 that passes the refrigerant to the vessel 134 after passing through a valve 210.

The refrigeration system 110 of the present invention improves the efficiency of prior art refrigeration systems by disposing of the accumulator 54. By varying the flow of the refrigerant through the heat lowering line 202 at the heat exchanger 206, the temperature of the refrigerant in the warm temperature line 200 is controlled to produce the desired warm liquid temperature. In the illustrated example, the heat exchanger 206 is a counter flow heat exchanger, which results in no (or negligible) operational penalty to warming the liquid.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

What is claimed is:

1. A refrigeration system comprising:
a condenser;
a compressor;
a first transportation system passing refrigerant between the compressor and the condenser;
a first evaporator;
a second evaporator;
a second transportation system passing the refrigerant between the condenser and a holding vessel, the holding vessel including refrigerant in gas and liquid form;
a third transportation system passing the refrigerant between the holding vessel and a pump;
a fourth transportation system passing the refrigerant between the pump and the first evaporator;
a fifth transportation system passing the refrigerant between the pump and the second evaporator; and
a heat exchanger wherein the refrigerant in the second transportation system exchanges heat with the refrigerant in the fifth transportation system to heat the refrigerant in the fifth transportation system before the refrigerant passes to the second evaporator;
wherein the refrigerant is expanded between the condenser and the first and second evaporators to lower the pressure of the refrigerant.

2. The refrigeration system of claim 1, wherein:
the refrigerant is ammonia.

3. The refrigeration system of claim 1, wherein:
the heat exchanger is a counter flow heat exchanger.

4. The refrigeration system of claim 1, wherein:
a sixth transportation system is located between the first and second evaporators and the vessel for transporting the refrigerant from the first and second evaporators to the vessel.

5. The refrigeration system of claim 1, wherein:
the refrigerant in gas form passes from the vessel to the compressor; and
the refrigerant in liquid form passes from the vessel to the pump.

6. The refrigeration system of claim 1, wherein:
the second evaporator is an air handler for cooling air in the air handler.

7. A method of refrigeration comprising:
providing a condenser, a compressor, a first evaporator, and a second evaporator;

transporting a refrigerant between the compressor and the condenser;

transporting the refrigerant between the condenser and a holding vessel, the holding vessel including refrigerant in gas and liquid form;

transporting the refrigerant between the holding vessel and a pump;

transporting the refrigerant between the pump and the first evaporator;

transporting the refrigerant between the pump and the second evaporator;

transporting the refrigerant between the pump and the first evaporator and between the pump and the second evaporator through a heat exchanger;

heating the refrigerant passing between the pump and the second evaporator with the refrigerant passing between the pump and the first evaporator in the heat exchanger; and expanding the refrigerant between the condenser and the first and second evaporators to lower the pressure of the refrigerant.

8. The method of refrigeration of claim 7, wherein:

the refrigerant is ammonia.

9. The method of refrigeration of claim 7, wherein:

the heat exchanger is a counter flow heat exchanger.

10. The method of refrigeration of claim 7, further including:

transporting the refrigerant from the first and second evaporators to the vessel.

11. The method of refrigeration of claim 7, further including:

transporting the refrigerant in gas form from the vessel to the compressor; and transporting the refrigerant in liquid form from the vessel to the pump.

12. The method of refrigeration of claim 7, wherein:

the first evaporator is an air handler for cooling air in the air handler.

* * * * *